US011759036B1

(12) United States Patent
Vellekamp

(10) Patent No.: US 11,759,036 B1
(45) Date of Patent: Sep. 19, 2023

(54) STORAGE BOX FOR KNIFE AND FORK WITH KNIFE SHARPENER

(71) Applicant: V NIVES, LLC, Puyallup, WA (US)

(72) Inventor: Isaac Vellekamp, Puyallup, WA (US)

(73) Assignee: V NIVES, LLC, Puyallup, WA (US)

( * ) Notice: Subject to any disclaimer, the term of this patent is extended or adjusted under 35 U.S.C. 154(b) by 0 days.

(21) Appl. No.: 17/957,264

(22) Filed: Sep. 30, 2022

(30) Foreign Application Priority Data

Sep. 21, 2022 (CN) ..... 202222511392.0

(51) Int. Cl.
*A47G 21/14* (2006.01)
*B24D 15/08* (2006.01)

(52) U.S. Cl.
CPC ..... *A47G 21/14* (2013.01); *B24D 15/08* (2013.01)

(58) Field of Classification Search
CPC ..... A47G 21/14; A47G 21/145; B24D 15/08
See application file for complete search history.

(56) References Cited

U.S. PATENT DOCUMENTS 2,845,323 A * 7/1958 Seibert, Jr. ..... A47G 21/14 312/351
3,034,264 A * 5/1962 McMaster ..... B24B 3/54 451/241
3,135,383 A * 6/1964 Bloch ..... A47G 21/14 D7/637
4,870,754 A * 10/1989 Chiou ..... A47G 21/14 206/553
4,912,885 A * 4/1990 Bonapace ..... B24D 15/081 76/82
4,940,143 A * 7/1990 Stanfield ..... A45C 13/02 248/37.3
4,979,610 A * 12/1990 Thomas ..... A47G 21/14 206/553
5,233,793 A * 8/1993 Dandurand ..... B24D 15/082 7/110
D348,591 S * 7/1994 Willis ..... D8/93
5,477,753 A * 12/1995 Branscum ..... B24D 15/08 76/82

(Continued)

FOREIGN PATENT DOCUMENTS

CA 2758777 A1 * 5/2013 ..... A47G 21/14
DE 202015006068 U1 * 10/2015 ..... A47G 21/14

(Continued)

*Primary Examiner* — Stanton L Krycinski
(74) *Attorney, Agent, or Firm* — Birch, Stewart, Kolasch & Birch, LLP

(57) ABSTRACT

A storage box includes a base having a bottom portion with inner and outer surfaces, and a peripheral wall surrounding the bottom portion to form a storage space with the inner surface. The outer surface has a placing slot and a knife sharpener fixing portion adjacent thereto. When the user places a knife sharpener in the storage space and closes a covering plate, the whole storage box is portable. The knife is sharpened when the covering plate is detached and embedded in the placing slot while the bottom portion is orientated upward, and the knife sharpener is disposed on the knife sharpener fixing portion. The user moves a knife back and forth between the knife sharpener by one hand and puts the other hand beside the covering plate to avoid being gashed by the knife in the knife sharpening process, thereby achieving protection purpose.

7 Claims, 6 Drawing Sheets

(56) References Cited

U.S. PATENT DOCUMENTS

| | | | | | |
|---|---|---|---|---|---|
| 6,663,096 | B2 * | 12/2003 | Heath | B24D 15/081 | 451/364 |
| 7,290,661 | B1 * | 11/2007 | DeFino | A47G 21/14 | 220/252 |
| 7,637,803 | B2 * | 12/2009 | Welch | A47G 21/14 | 451/555 |
| D630,914 | S * | 1/2011 | Aviles | D7/698 | |
| 8,689,979 | B2 * | 4/2014 | Rowe | A47G 21/14 | 220/523 |
| 8,721,403 | B2 * | 5/2014 | Welch | A47G 21/14 | 206/553 |
| 8,905,825 | B2 * | 12/2014 | Huff | B24D 15/081 | 451/344 |
| 9,980,613 | B2 * | 5/2018 | Lin | B24D 15/081 | |
| 11,351,655 | B1 * | 6/2022 | Samuel | B24B 3/52 | |
| 11,503,961 | B1 * | 11/2022 | Davidson | A47J 47/005 | |
| 2003/0193123 | A1 * | 10/2003 | Heath | B24D 15/081 | 269/289 R |
| 2004/0229554 | A1 * | 11/2004 | Kaposi | A47J 47/005 | 451/319 |
| 2014/0091508 | A1 * | 4/2014 | Chalifoux | A47J 47/005 | 206/553 |
| 2017/0014001 | A1 * | 1/2017 | Lin | A47J 47/005 | |

FOREIGN PATENT DOCUMENTS

| | | | | |
|---|---|---|---|---|
| EP | 3473141 | A1 * | 4/2019 | A47G 21/14 |
| GB | 191404635 | A * | 10/1914 | |
| KR | 200424268 | Y1 * | 8/2006 | |
| KR | 20100007365 | A * | 1/2010 | |
| KR | 100965231 | B1 * | 6/2010 | |
| TW | 263822 | U | 11/1995 | |

* cited by examiner

STORAGE BOX FOR KNIFE AND FORK WITH KNIFE SHARPENER

BACKGROUND OF THE INVENTION

1. Field of the Invention

The present invention relates to a storage box for a knife and a fork and more particularly, to a storage box for a knife and a fork, which is convenient to carry and has a knife sharpener.

2. Description of the Related Art

Camping and outdoor cooking activities are popular in recent years. In order to cook and process ingredients, frequently used kitchen utensils and knives must be carried together for use. But there are various kinds of kitchen utensils and knives. If a knife sharpener is also carried, it is relatively larger in volume and thereby not convenient to carry easily.

For solving the above-described problem, Taiwan Patent No.263822 disclosed a knife rack structure having a rack main body. The rack main body is provided on one side thereof with a plurality of rack plates arranged at intervals for hanging knives, and provided on another side with taper whetstones arranged symmetrically. The whetstones are driven by an electric motor and a transmission mechanism in the main body to sharpen a knife. However, the conventional knife rack structure is relatively larger in volume, not only inconvenient to carry, but also having no protecting function, resulting in that the hand of the user is liable to be cut or gashed accidentally in the knife sharpening process.

SUMMARY OF THE INVENTION

The present invention has been accomplished in view of the above-noted circumstances. It is a primary objective of the present invention to provide a storage box for a knife and a fork with a knife sharpener, which is convenient for the user to carry the needed knife and knife sharpener and perform the knife sharpening process instantaneously.

It is another objective of the present invention to provide a storage box for a knife and a fork with a knife sharpener, which has a protecting function for preventing the hand of the user from being gashed in the knife sharpening process.

To attain the above objective, the present invention provides a storage box for a knife and a fork, which has a base, a covering plate, and a knife sharpener. The base has a bottom portion and a peripheral wall connected with the bottom portion and surrounding the bottom portion. The bottom portion has an inner surface and an outer surface. A storage space is formed by the inner surface and the peripheral wall. The outer surface has a placing slot, and a knife sharpener fixing portion located on a side of the placing slot. The covering plate is optionally combined with the base at a covering plate closing position or a covering plate using position. When the covering plate is located at the covering plate closing position, the covering plate is fitted on the peripheral wall and covers the storage space. When the covering plate is located at the covering plate using position, the covering plate is embedded in the placing slot. The knife sharpener is optionally disposed on the base at a knife sharpener storing position or a knife sharpener using position. When the knife sharpener is located at the knife sharpener storing position, the knife sharpener is stored in the storage space. When the knife sharpener is located at the knife sharpener using position, the knife sharpener is fixed to the knife sharpener fixing portion.

By the above-described technical features, when not using the knife sharpener, the user can firstly detach the covering plate from the covering plate closing position to place the needed knife and the knife sharpener into the storage space together, and then disposed the covering plate at the covering plate closing position. At this time, the user can carry the whole storage box with the knife and the fork around. When the knife sharpener is to be used, the user firstly detaches the covering plate from the covering plate closing position to take out the knife and the knife sharpener from the storage space, then flips the base over to make the outer surface of the bottom portion face upward, then disposes the covering plate at the covering plate using position, and at last disposes the knife sharpener at the knife sharpener using position. At this time, the user can hold the knife and move it back and forth between the knife sharpener by one hand, and put the other hand on a side of the covering plate not facing the knife sharpener. The protecting function is provided by the covering plate blocking the hand not holding the knife. In this way, when sharpening the knife at different angles, the user has no need to worry about that the back-and-forth movements of sharpening the knife may gash or cut the other hand. In other words, the storage box for the knife and the fork provided by the present invention not only has the storage space for storing the knife sharpener for the convenience of carrying, but also has the protecting function to make the operating user feel safe to use.

Preferably, the outer surface of the base has a recessed portion; the recessed portion is provided therein with a knife sharpener fixing block; the knife sharpener fixing portion is formed by the knife sharpener fixing block.

Preferably, the knife sharpener fixing block has two oblique holes; the two oblique holes extend toward different directions and disposed in a staggered manner; the knife sharpener has two knife sharpening rods; the two knife sharpening rods are inserted in the oblique holes respectively. In this way, the two knife sharpening rods can be quickly disposed at angles for forming a V-shape for the user to perform the knife sharpening process conveniently.

Preferably, the recessed portion communicates with the placing slot, and the knife sharpener fixing block has an abutting side protruding into the placing slot; the abutting side of the knife sharpener fixing block is abutted against the covering plate located at the covering plate using position. In this way, the covering plate can be stably inserted in the placing slot and not easy to sway, thereby having great positioning effect.

Preferably, the placing slot has two sides opposite to each other; at least one of the two sides extends obliquely.

Preferably, the base has a hook; the covering plate has a buckle; the buckle of the covering plate is clasped to the hook of the base. In this way, the covering plate is convenient to attach and detach.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
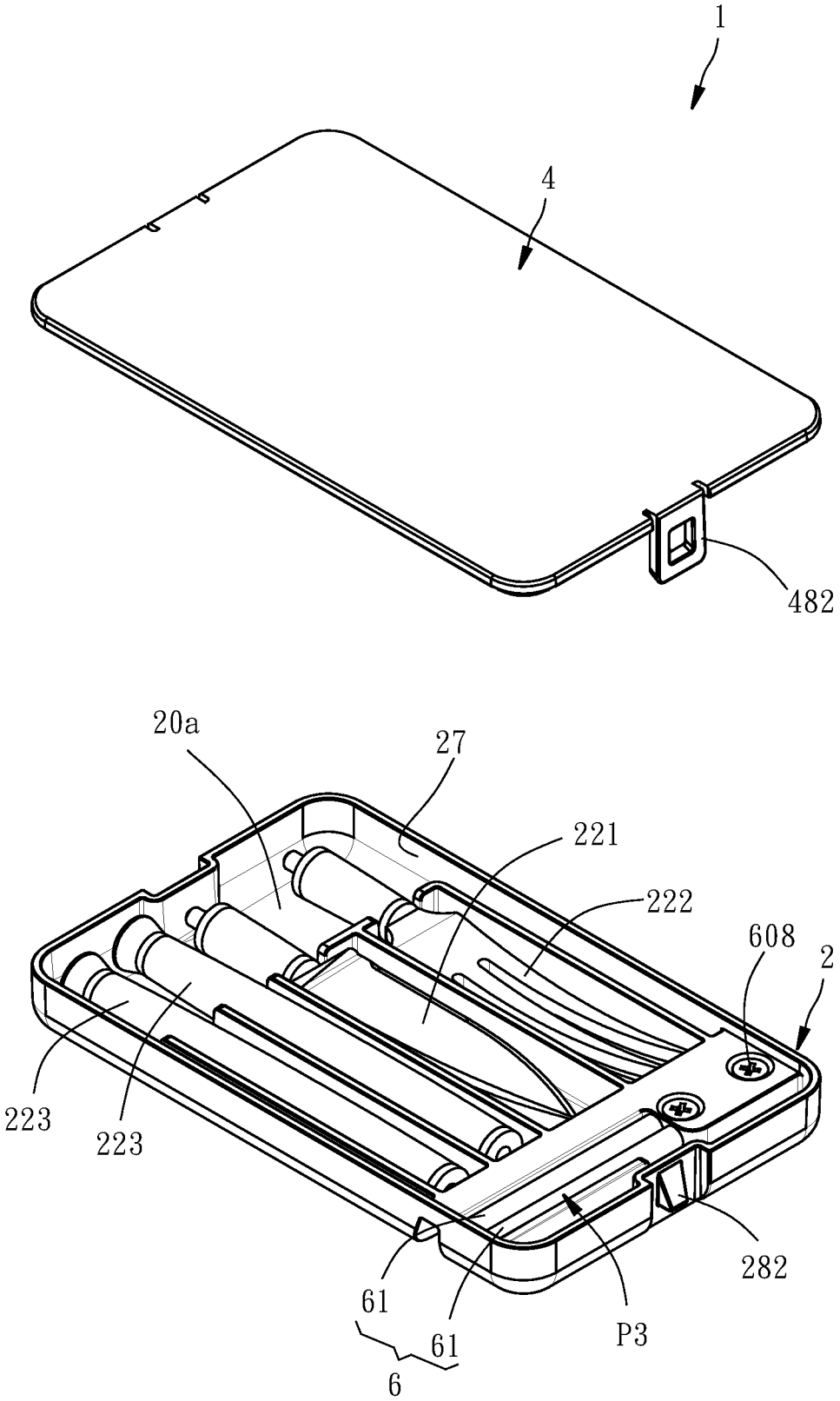
FIG. 1 is an exploded perspective view of a storage box for a knife and a fork of the present invention, showing the condition that the knife and knife sharpening rods are stored in a base.

First of all, it is to be mentioned that throughout this specification, including the following embodiment and claims, the directional terms are all based on the direction shown in the figures. Besides, same reference numerals used in the following embodiment and the figures designate same or similar elements or the structural features thereof.

Referring to FIG. 1, a storage box 1 for a knife and a fork of the present invention has a base 2, a covering plate 4, and a knife sharpener 6.

Figure 2:
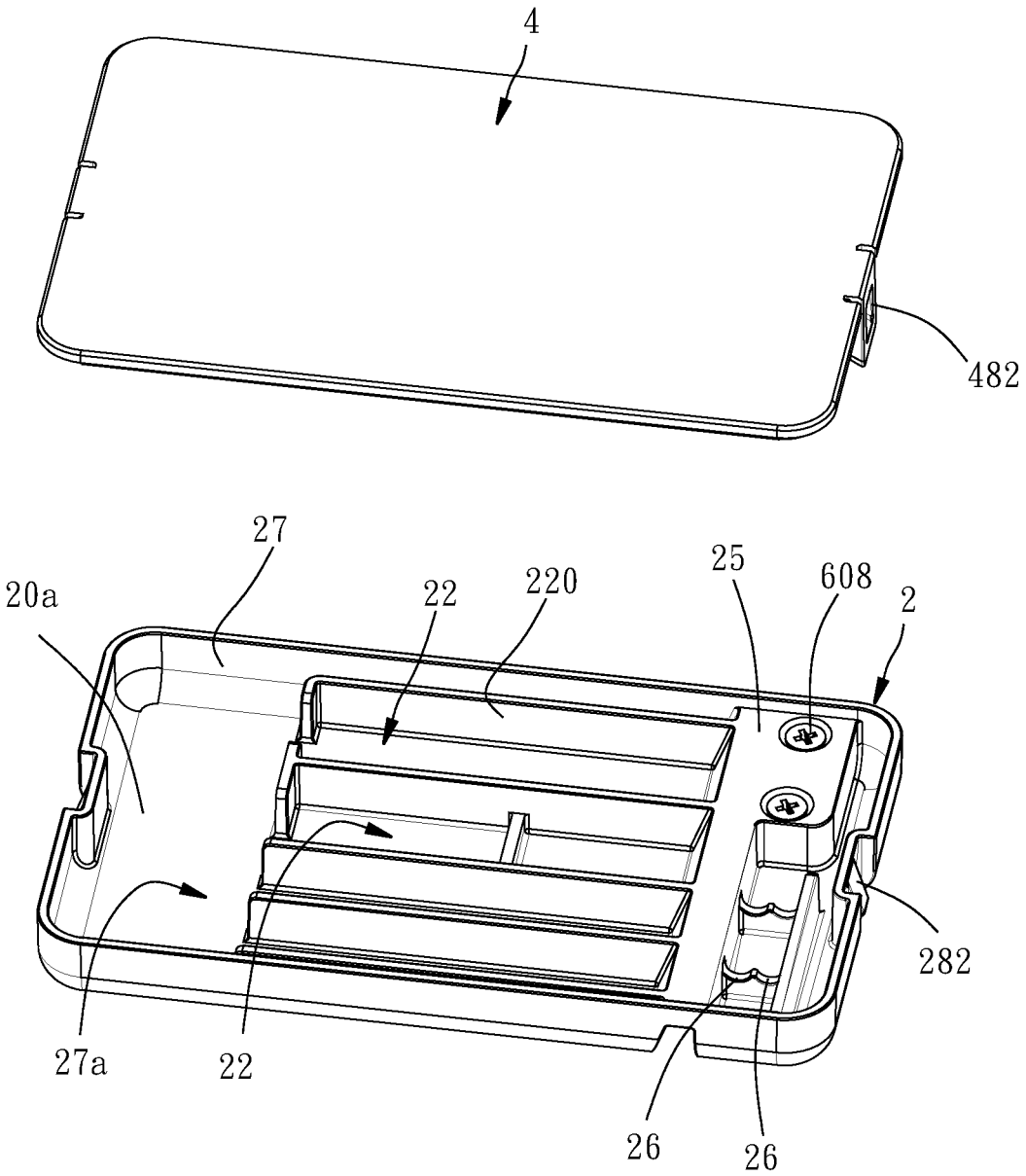
FIG. 2 is an exploded perspective view of the storage box for the knife and the fork of the present invention, showing the condition that a covering plate is detached from a covering plate closing position.
Figure 3:
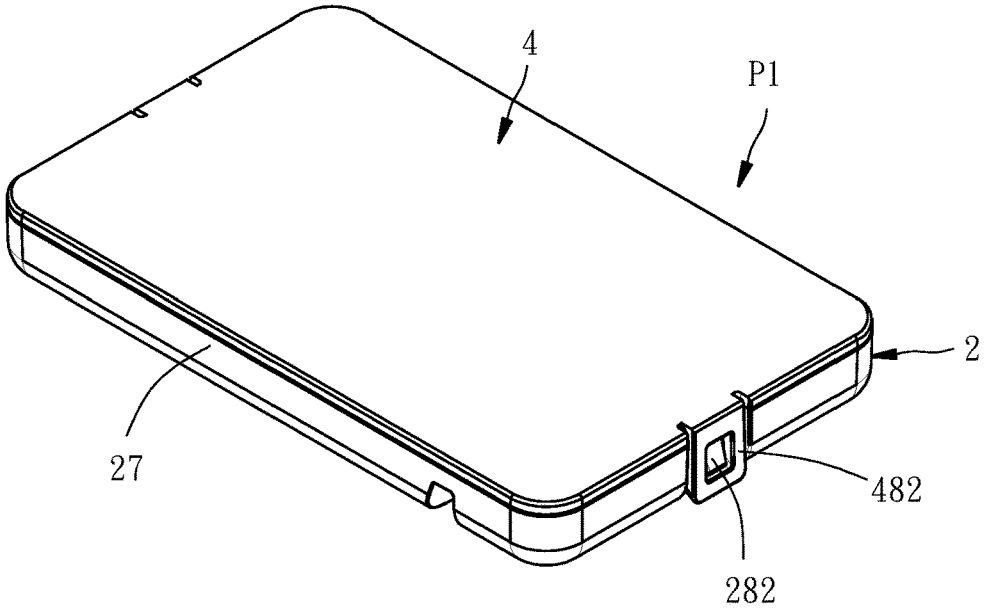
FIG. 3 is a perspective view of the storage box for the knife and the fork of the present invention, showing the condition that the covering plate is located at the covering plate closing position.
Figure 5:
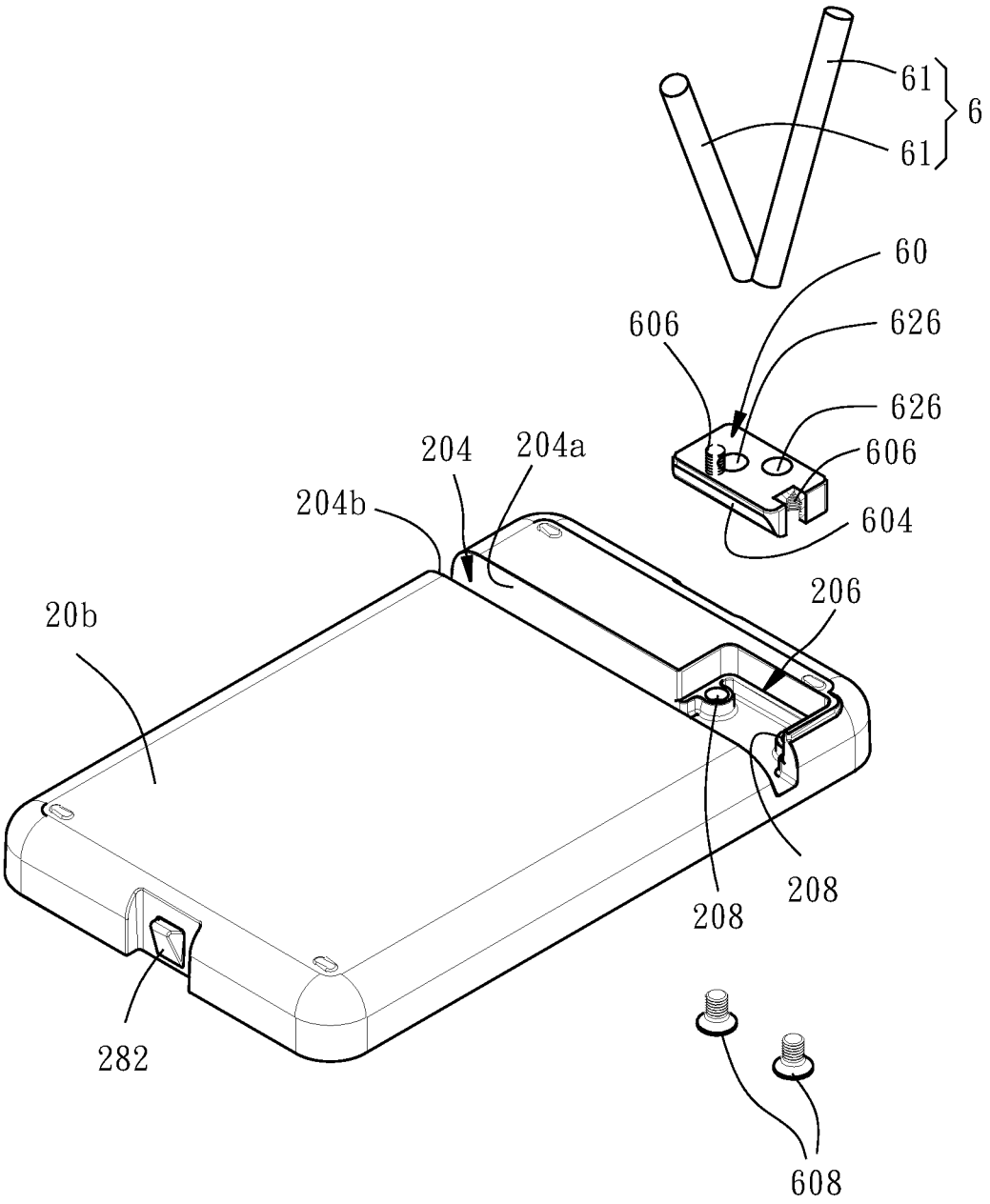
FIG. 5 is a partially exploded perspective view of the storage box for the knife and the fork of the present invention, showing that a knife sharpener fixing block is connected to the base in a fastening manner by screws.
Figure 6:
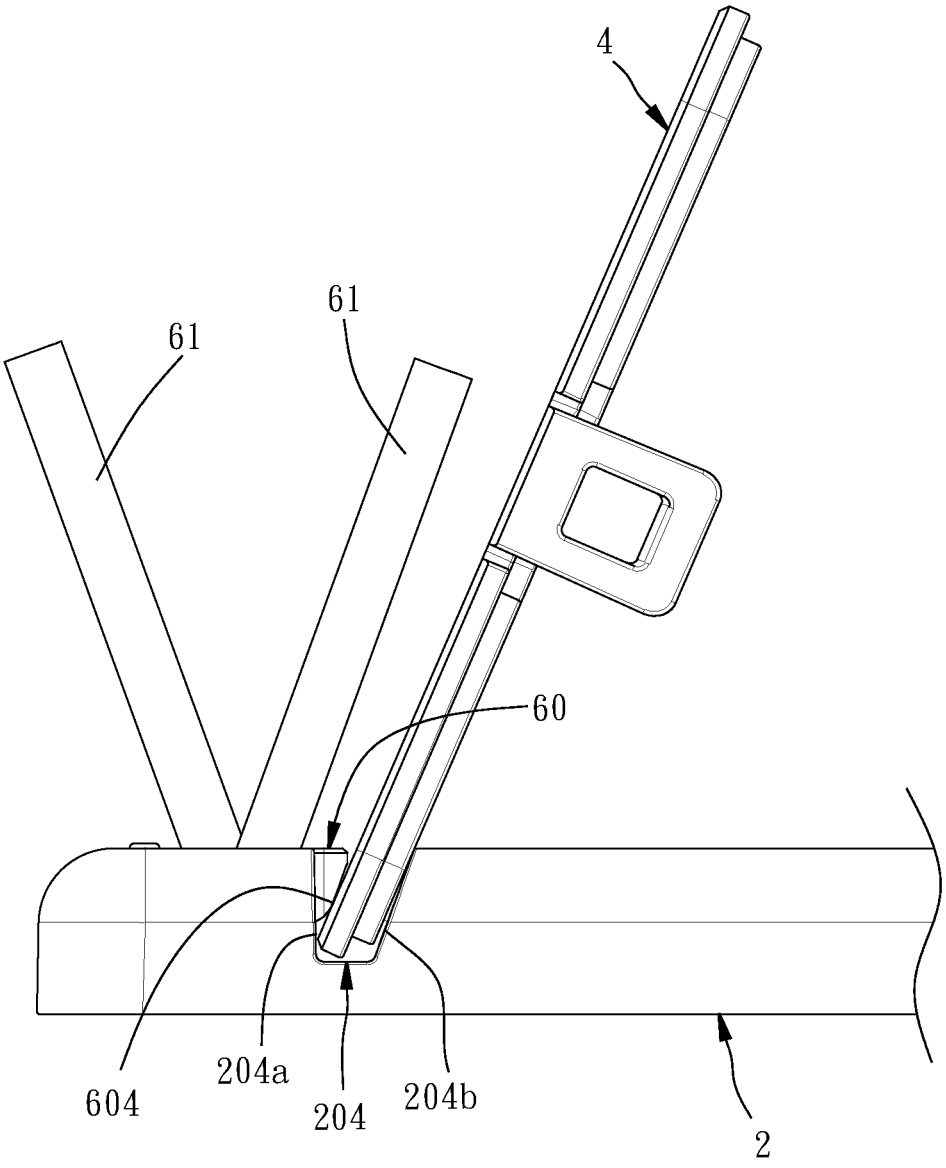
FIG. 6 is a side view of the storage box for the knife and the fork of the present invention, showing that an abutting side of the knife sharpener fixing block is abutted against the covering plate.
Figure 7:
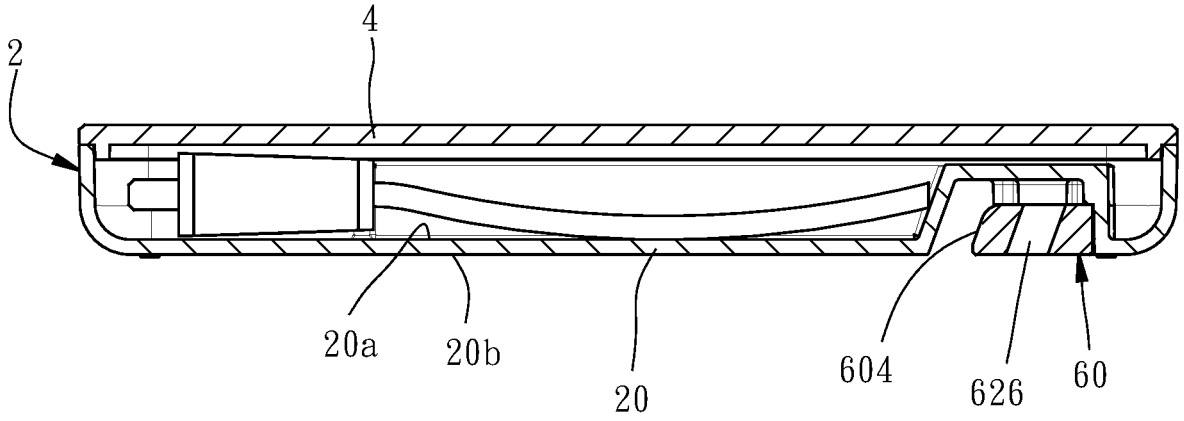
FIG. 7 is a sectional view of the storage box for the knife and the fork of the present invention, showing oblique holes of the knife sharpener fixing block.

The base 2 includes a bottom portion 20 and a peripheral wall 27. The bottom portion 20 has an inner surface 20*a* and an outer surface 20*b* (as shown in FIG. 7). The peripheral wall 27 is connected with the bottom portion 20 and surrounds the periphery of the bottom portion 20, so that a storage space 27*a* (as shown in FIG. 2 and FIG. 3) is formed between the inner surface 20*a* and the inner surface of the peripheral wall 27. The outer surface of the peripheral wall 27 has two hooks 282 provided oppositely. Besides, the outer surface 20*b* has a placing slot 204 and a recessed portion 206 communicating with the placing slot 204. In this embodiment, a knife sharpener fixing block 60 is disposed in the recessed portion 206. A knife sharpener fixing portion of the base 2 is formed by the knife sharpener fixing block 60. Further speaking, as shown in FIG. 5, the recessed portion 206 has two through holes 208. The top surface of the knife sharpener fixing block 60 has two threaded holes 606. Two screws 608 are inserted through the two through holes 208 and screwed into the two threaded holes 606 to fasten the knife sharpener fixing block 60 in the recessed portion 206. Besides, as shown in FIG. 6, the knife sharpener fixing block 60 has an abutting side 604 protruding into the placing slot 204. In addition, as shown in FIG. 5 and FIG. 7, the bottom surface of the knife sharpener fixing block 60 includes two oblique holes 626. The two oblique holes 626 are located between the aforementioned two threaded holes 606, and the two oblique holes 626 extend toward different directions and disposed in a staggered manner.

It should be additionally mentioned here that the knife sharpener fixing block 60 is unlimited to be combined with the base 2 in the fastening manner by the screws 608, but may be connected with the base 2 in an integrally formed manner to make the outer surface 20*b* of the base 2 directly formed with a knife sharpener fixing portion. In this way, the use of the screws 608 can be omitted to achieve the effect of simplifying the structure.

As shown in FIG. 2, the base 2 further includes five partition plates 220 and a protruding platform 25. The partition plates 220 are disposed in the storage space 27*a*, and an accommodating groove 22 is formed between two adjacent partition plates 220. The accommodating grooves 22 are adapted to accommodate a knife 221 and a fork 222 needed for cutting ingredients, and extending handles 223 used in coordination with the above two, as shown in FIG. 1. The protruding platform 25 is disposed adjacent to four accommodating grooves 22 and includes two knife sharpening rod accommodating grooves 26.

Figure 4:
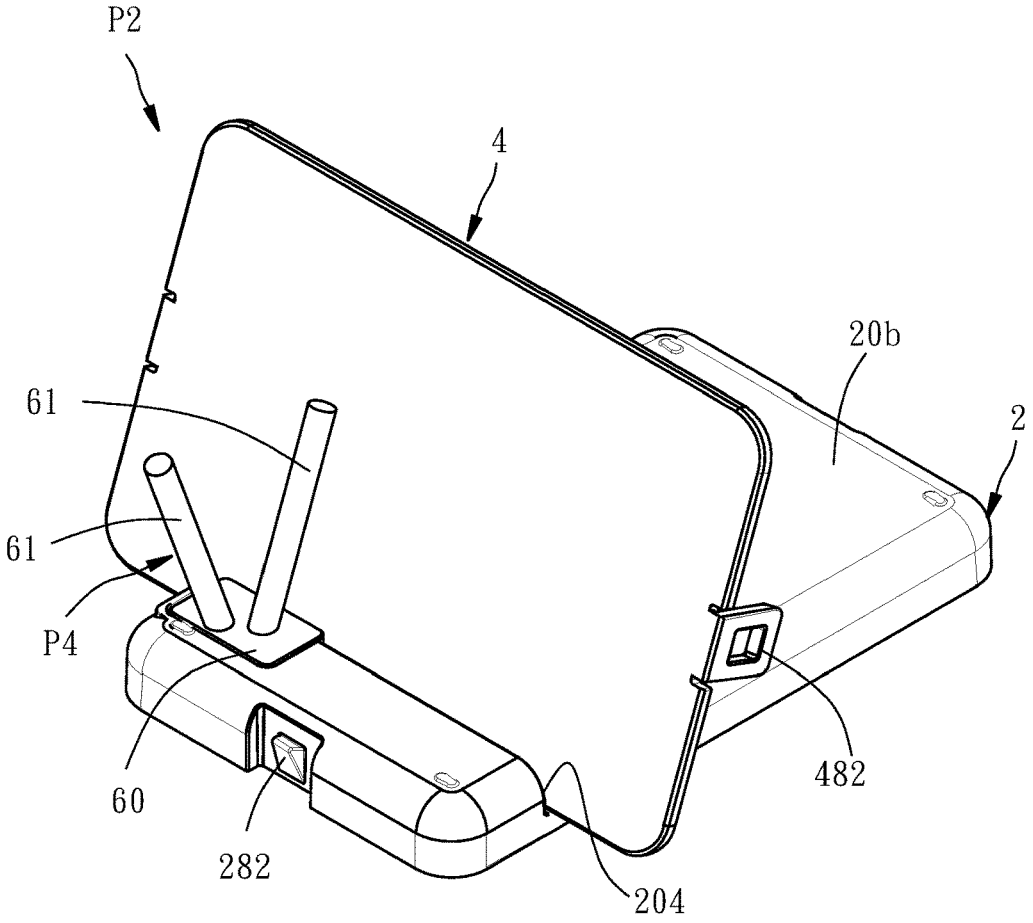
FIG. 4 is a perspective view of the storage box for the knife and the fork of the present invention, showing that the covering plate is located at a covering plate using position and the knife sharpening rods are located at a knife sharpener using position.

The left and right ends of the covering plate 4 each have a buckle 482. When the two buckles 482 of the covering plate 4 are clasped to the two hooks 282 of the base 2, the covering plate 4 is located at a covering plate closing position P1 as shown in FIG. 3. At this time, the covering plate 4 is fitted on the peripheral wall 27 and covers the storage space 27*a*. When the two buckles 482 of the covering plate 4 are separated from the two hooks 282 of the base 2, the covering plate 4 is detached from the base 2 and able to be inserted in the placing slot 204 of the base 2, so that the covering plate 4 is located at a covering plate using position P2 as shown in FIG. 4. At this time, the abutting side 604 (as shown in FIG. 7) of the knife sharpener fixing block 60 is abutted against the covering plate 4, so that the covering plate 4 can be stably inserted in the placing slot 204 and not easy to sway, thereby having great positioning effect. Besides, as shown in FIG. 6, the placing slot 204 of the base 2 has two sides 204*a* and 204*b* opposite to each other, wherein the side 204*b* extends obliquely, so that the covering plate 4 can be disposed obliquely by leaning on the side 204*b* when being inserted in the placing slot 204.

In this embodiment, the knife sharpener 6 includes two knife sharpening rods 61. When the knife sharpener 6 is located at a knife sharpener storing position P3 as shown in FIG. 1, the two knife sharpening rods 61 are stored in the two knife sharpening rod accommodating grooves 26. When the knife sharpener 6 is located at a knife sharpener using position P4 as shown in FIG. 4, the two knife sharpening rods 61 are inserted in the two oblique holes 626 of the knife sharpener fixing block 60 by an end thereof, so that the two knife sharpening rods 61 are disposed at angles forming a V-shape.

It can be known from the above description that when the knife sharpener 6 is to be used, the user firstly detaches the covering plate 4 from the covering plate closing position P1 and takes out the knife 221, the fork 222, the extending handles 223 and the knife sharpener 6, then flips the base 2 over to make the outer surface 20*b* face upward, then disposes the covering plate 4 at the covering plate using position P2 as shown in FIG. 4, and at last disposes the knife sharpener 6 at the knife sharpener using position P4 as shown in FIG. 4. At this time, the user can hold the knife 221 and move it back and forth between the two knife sharpening rods 61 by one hand, and put the other hand on one side of the covering plate 4 not facing toward the two knife sharpening rods 61 to apply a force to press the base 2 for support. When the user performs the back-and-forth movements of sharpening the knife at different angles, the movements will be stopped while the knife 221 is abutted against the covering plate 4, so that a protecting effect is brought to prevent the hand pressing the base 2 from being cut by the knife 221, thereby much reducing the risk of injury.

When the knife sharpening process is finished, the user firstly takes out the covering plate 4 and the knife sharpener 6 from the placing slot 204 and the oblique holes 626 respectively, then flips the base 2 over back to put the knife 221, the fork 222 and the extending handles 223 into the accommodating grooves 22 and store the two knife sharpening rods 61 into the two knife sharpening rod accommodating grooves 26, and at last installs the covering plate 4 back to the covering plate closing position P1 as shown in FIG. 3 to finish the storing process. At this time, the user can carry the whole storage box 1 with the knife and the fork around.

In conclusion, the storage box 1 for the knife and the fork of the present invention has the storage space 27*a* for storing the knife 221 and the knife sharpener 6, thereby convenient to carry. Besides, in the knife sharpening process, the covering plate 4 is used for providing the protecting function, so that the operating user feels safe to use and thereby the objective of the present invention is attained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A storage box for a knife and a fork, the storage box comprising:

a base having a bottom portion and a peripheral wall connected with the bottom portion and surrounding the bottom portion, the bottom portion having an inner surface and an outer surface, a storage space being formed by the inner surface and the peripheral wall, the outer surface having a placing slot and a knife sharpener fixing portion located on a side of the placing slot;

a covering plate combinable with the base at a covering plate closing position and a covering plate using position, when the covering plate being located at the covering plate closing position, the covering plate being fitted on the peripheral wall and covering the storage space, when the covering plate being located at the covering plate using position, the covering plate being embedded in the placing slot; and a knife sharpener disposable on the base at a knife sharpener storing position and a knife sharpener using position, when the knife sharpener being located at the knife sharpener storing position, the knife sharpener being stored in the storage space, when the knife sharpener being located at the knife sharpener using position, the knife sharpener being fixed to the knife sharpener fixing portion.

2. The storage box as claimed in claim 1, wherein the outer surface of the base has a recessed portion; the recessed portion is provided therein with a knife sharpener fixing block; the knife sharpener fixing portion is formed by the knife sharpener fixing block.

3. The storage box as claimed in claim 2, wherein the knife sharpener fixing block has two oblique holes; the two oblique holes extend toward different directions and disposed in a staggered manner; the knife sharpener has two knife sharpening rods; the two knife sharpening rods are insertable in the oblique holes respectively.

4. The storage box as claimed in claim 2, wherein the recessed portion communicates with the placing slot, and the knife sharpener fixing block has an abutting side protruding into the placing slot for being abutted against the covering plate located at the covering plate using position.

5. The storage box as claimed in claim 1, wherein the placing slot has two sides opposite to each other; at least one of the two sides extends obliquely from a bottom of the placing slot.

6. The storage box as claimed in claim 1, wherein the knife sharpener fixing portion has two oblique holes; the two oblique holes extend toward different directions and disposed in a staggered manner; the knife sharpener has two knife sharpening rods; the two knife sharpening rods are insertable in the oblique holes respectively.

7. The storage box as claimed in claim 1, wherein the base has a hook; the covering plate has a buckle; the buckle is clasped to the hook in the covering plate closing position.

* * * * *